US005353698A

United States Patent [19]

Robbins

[11] Patent Number: 5,353,698

[45] Date of Patent: Oct. 11, 1994

[54] METHOD FOR COMPACTING MATERIAL USING A HORIZONTAL BALER WITH MOVABLE BOTTOM SUPPORT EJECTOR

[75] Inventor: James K. Robbins, Fayette, Ala.

[73] Assignee: Marathon Equipment Company, Vernon, Ala.

[21] Appl. No.: 126,644

[22] Filed: Sep. 27, 1993

Related U.S. Application Data

[62] Division of Ser. No. 858,070, Mar. 26, 1992, Pat. No. 5,247,880.

[51] Int. Cl.[5] ..... B30B 15/32; B65B 13/20

[52] U.S. Cl. ..... 100/3; 100/7; 100/25; 100/218; 100/255

[58] Field of Search ..... 100/3, 7, 25, 218, 249, 100/250, 252, 255

[56] References Cited

U.S. PATENT DOCUMENTS

| | | | |
|---|---|---|---|
| 273,407 | 3/1883 | Tyack | 100/218 |
| 850,105 | 4/1907 | Spencer | 100/25 |
| 2,371,762 | 3/1945 | Langford et al. . | |
| 2,732,792 | 1/1956 | White | 100/3 X |
| 3,929,062 | 12/1975 | Thompson | 100/3 |
| 4,007,677 | 2/1977 | Fox | 100/218 X |
| 4,033,249 | 7/1977 | Schmalz et al. | 100/3 |
| 4,294,169 | 10/1981 | Baird | 100/255 X |
| 4,450,764 | 5/1984 | Montgomery | 100/37 |

FOREIGN PATENT DOCUMENTS

| | | | |
|---|---|---|---|
| 1172100 | 8/1984 | Canada | 100/3 |
| 2257567 | 5/1974 | Fed. Rep. of Germany | 100/3 |
| 3412307 | 10/1985 | Fed. Rep. of Germany . | |
| 85/01013 | 3/1985 | PCT Int'l Appl. | 100/229 A |

*Primary Examiner*—Stephen F. Gerrity
*Attorney, Agent, or Firm*—Joseph W. Berenato, III

[57] ABSTRACT

A horizontal baler has a longitudinally extending generally rectangular frame assembly defining a receiving chamber and an adjacent aligned compaction chamber. Each of the chambers has a top, a bottom, and sides. A ram is mounted for reciprocation within the receiving chamber so that material therein may be transferred to the compaction chamber and compacted therein by reciprocation thereof. A first cylinder and piston assembly is longitudinally disposed within the frame assembly and is operably associated with the ram for causing reciprocation thereof. A door defines one of the sides of the compaction chamber. The door is selectively securable and movable relative to an opening communicating with the compaction chamber. A support defines a portion of the bottom of the compaction chamber. The support is reciprocable transverse to the first cylinder and piston assembly and is aligned with the door for moving compacted material through the opening. A second cylinder and piston assembly is disposed below and operably associated with the support for causing reciprocation thereof. The second cylinder and piston assembly is disposed transverse to the first cylinder and piston assembly. A strapping assembly is operably associated with the compaction chamber for permitting material compacted therein to be strapped prior to being moved through the opening.

18 Claims, 5 Drawing Sheets

FIG. 9
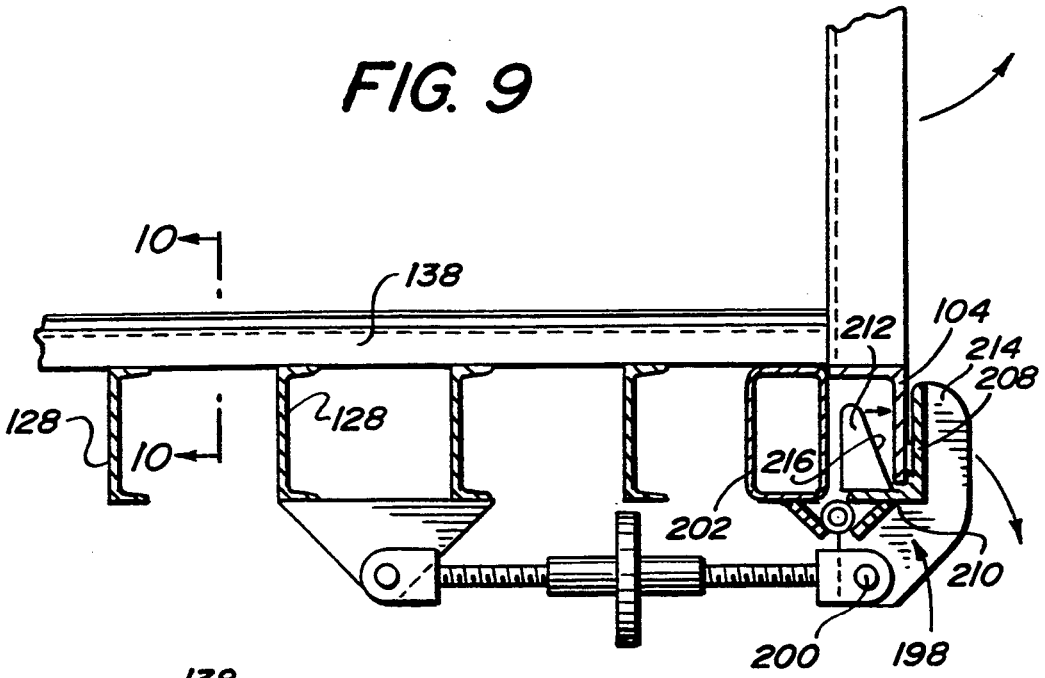
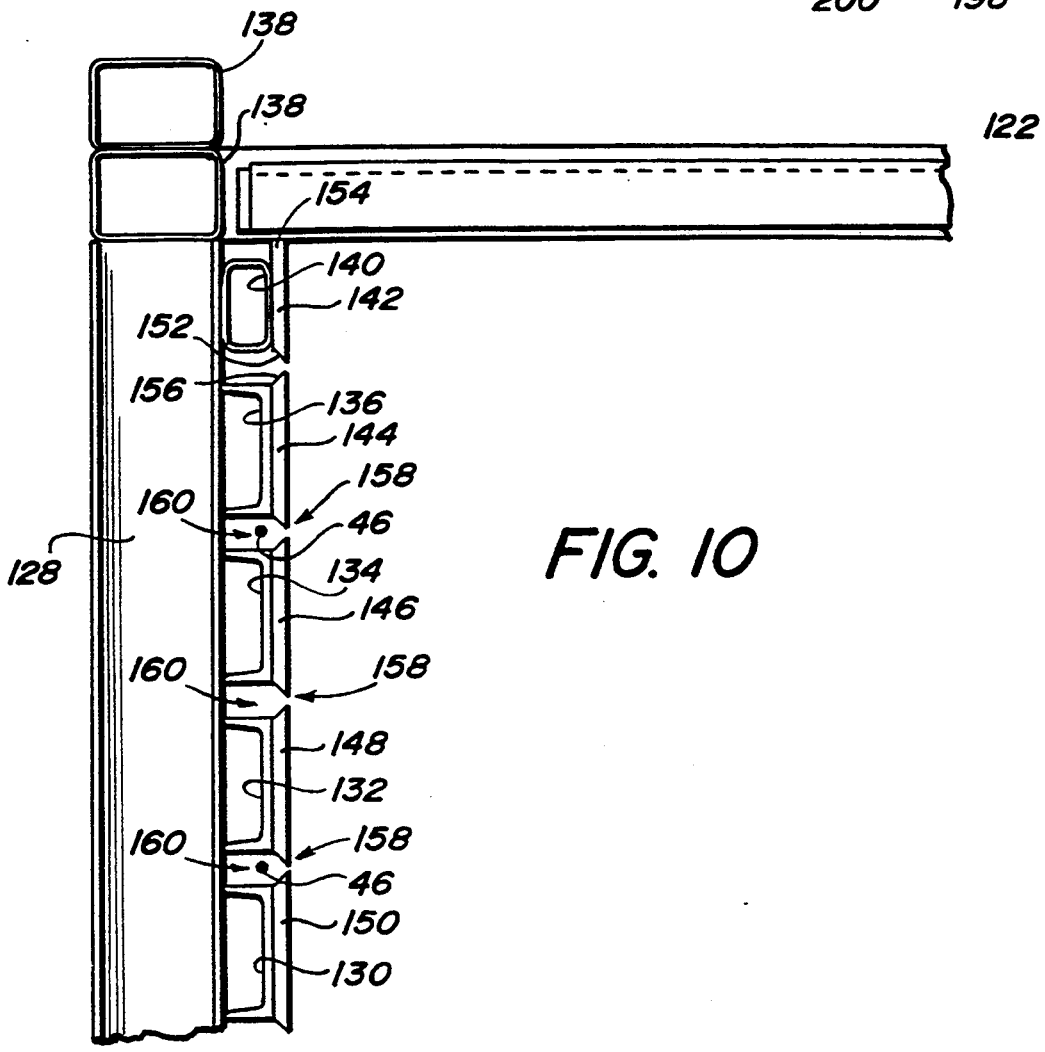
FIG. 10

FIG. 11
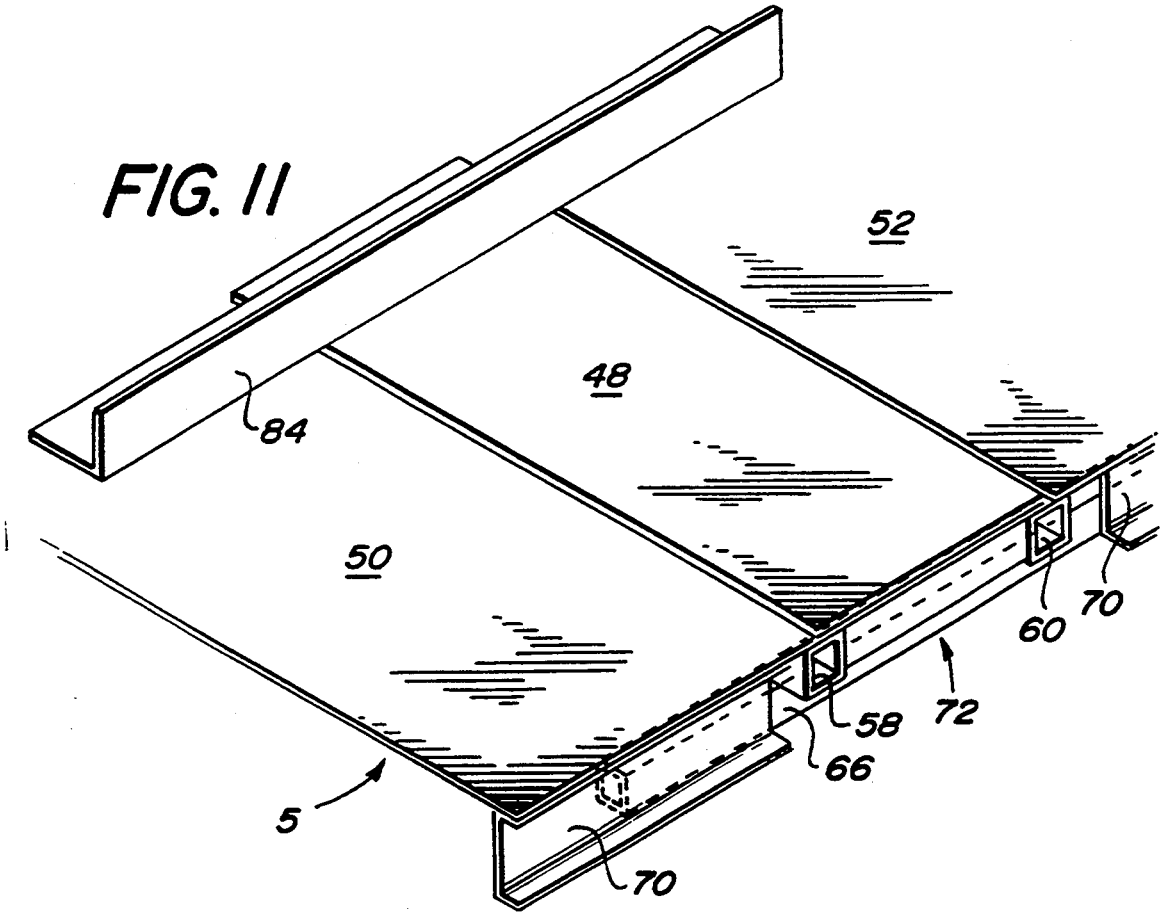
FIG. 13
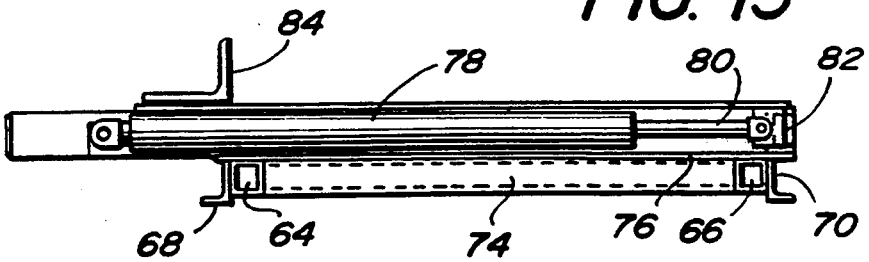
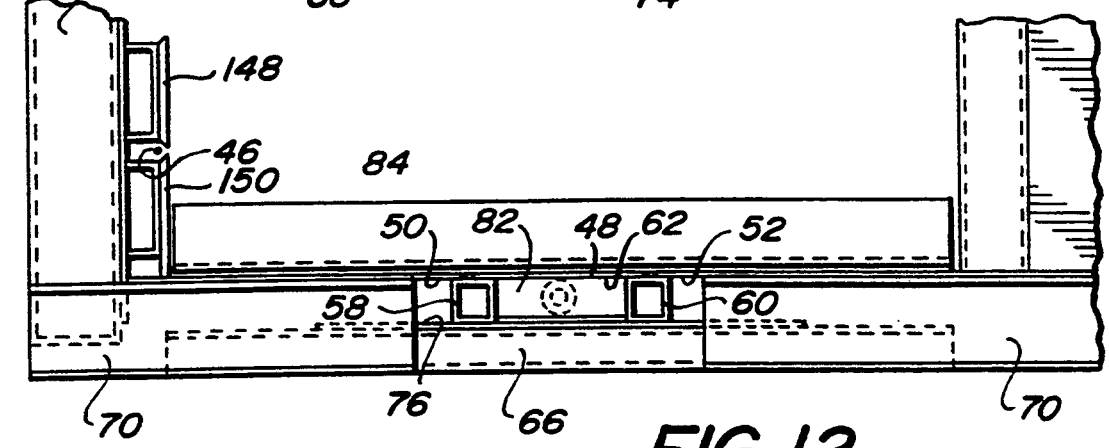
FIG. 12

METHOD FOR COMPACTING MATERIAL USING A HORIZONTAL BALER WITH MOVABLE BOTTOM SUPPORT EJECTOR

This is a division of application Ser. No. 07/858,070 filed Mar. 26, 1992 (U.S. Pat. No. 5,247,880.

FIELD OF THE INVENTION

The disclosed invention is directed to a machine for baling waste materials, in particular recyclable waste materials. More specifically, the disclosed invention is directed to a horizontal baler wherein the material is first compressed within a compaction chamber by a first hydraulically operated ram, the compressed material is then banded while in the compaction chamber, the compaction pressure is then released, and finally the bale is discharged by a second hydraulic ram movable transversely to the first ram.

BACKGROUND OF THE INVENTION

Baling machines for waste and other compressible materials may be of either the horizontal or the vertical configuration. Regardless of the orientation of the baler, waste material is advanced from a receiving chamber to a compaction chamber wherein compression of the material occurs as additional material is transferred. Once the material has attained a sufficient degree of compression, then there is a need for the compressed material to be strapped in order to maintain the compressed condition during handling and transport.

Certain balers, known as two-ram balers, utilize a full-size, high-power ram for transferring the compressed material from the compression or compaction chamber into a separate strapping chamber in which the bale is tied. Other balers utilize automatic strappers that apply one strap at a time as the bale is incrementally ejected from the compression chamber by a full-size, high-power ram. Each of these types of two-ram balers is relatively expensive because of the cost of the full-sized ram and its high-powered hydraulic system.

Another type of baler is the closed-end horizontal baler. These balers require that a formed bale be ejected by the next subsequent bale being formed. Closed-end balers permit the compressed materials to be intermingled, because the material being compressed for one bale may become enmeshed in the immediately precedent bale. Closed-end balers also require careful monitoring in order to permit the operator to know when the bale has been ejected. Because intermingling of materials may occur in a closed-end baler, then they are not practicable for recycling of materials. Recycling has received renewed interest recently, but recycling customarily requires that different materials be kept separated.

Those skilled in the art will understand that there is a need for a relatively high capacity two-ram baler which is suitable for use in the recycling industry. Such a two-ram baler should be relatively inexpensive, should prevent intermingling of materials, and should occupy as little space as possible. The disclosed invention is a two-ram horizontal baler which straps the formed bale in the compression chamber, and which transversely ejects the bale with a relatively low powered hydraulic ram because the compaction pressure is relieved by a pivotal top on the chamber and partial retraction of the ram prior to bale ejection.

OBJECTS AND SUMMARY OF THE INVENTION

The primary object of the disclosed invention is to provide a two-ram horizontal baler which relieves the compaction pressure on the bale in order to permit a relatively low pressure cylinder to be used for bale ejection.

Another object of the disclosed invention is to provide a method for baling materials which relieves the compaction pressure after the bale has been tied but prior to ejection.

A horizontal baler according to the invention comprises a longitudinally extending generally rectangular frame assembly defining a receiving chamber and an adjacent aligned compaction chamber. Each of the chambers has a top, bottom, and sides. A ram is mounted for reciprocation within the receiving chamber so that material therein may be transferred to the compaction chamber and compacted therein by reciprocation of the ram. A first cylinder and piston assembly is longitudinally disposed within the frame assembly and is operably associated with the ram for causing reciprocation thereof. A door defines one of the sides of the compaction chamber. The door is selectively securable and movable relative to an opening communicating with the compaction chamber. A support defines a portion of the bottom of the compaction chamber. The support is reciprocal transverse to the first cylinder and piston assembly and is aligned with the door for moving compacted material through the opening. A second cylinder and piston assembly is disposed below and operably associated with the support for causing reciprocation thereof. The second cylinder and piston assembly is disposed transverse to the first cylinder and piston assembly. A strapping means is operably associated with the compaction chamber for permitting material compacted therein to be strapped prior to being moved by the support through the opening.

A horizontal baler comprises a longitudinally extending generally rectangular ground engaging frame assembly defining a receiving chamber and a compaction chamber. Each of the chambers has a top, a bottom, and sides. A ram is mounted for reciprocation within the receiving chamber for transferring material therefrom into the compacting chamber and for causing compaction therein by reciprocation. The ram has a plurality of spaced parallel slots. A door defines one of the sides of the compaction chamber and is pivotal between a first position closing the compaction chamber and a second position remote therefrom and thereby providing an opening to the compaction chamber. The door has a plurality of spaced parallel slots. First and second transversely disposed walls define two sides of the compaction chamber. The first wall extends transverse to the door when the door is in the first position so that the second wall extends parallel thereto. Each of the walls has a plurality of spaced parallel slots. The slots of each of the walls, the door, and the ram are aligned and permit a banding strap to be inserted therein and thereby about the compaction chamber for permitting material within the compaction chamber to be secured thereby. Means are operably associated with the compaction chamber for discharging baled material therefrom through the opening.

A method of baling material comprises the steps of placing material to be baled into a receiving chamber. A ram is reciprocated between first and second ends of the receiving chamber for thereby transferring the material into an adjacent compaction chamber limited by the ram when the ram is at the first end. Material is continually placed into the receiving chamber and is transferred therefrom into the compaction chamber by the reciprocating ram for thereby causing the material in the compaction chamber to be compacted into a bale. Straps are placed about the bale while in the compaction chamber after a desired degree of compaction has been achieved. The compaction pressure on the bale is relieved by moving the ram from the first end toward the second end, so that the bale therefore may expand against the straps. The strapped bale is then discharged from the compaction chamber.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 9 is an enlarged fragmentary top plan view, partially in section, of the door latching mechanism of the invention;

FIG. 10 is a fragmentary cross sectional view taken along the line 10—10 of FIG. 9;

FIG. 11 is a fragmentary perspective view, with portions broken away for clarity, of the bale transport system of the invention;

FIG. 12 is a fragmentary elevational view of the bale transport system of FIG. 11; and FIG. 13 is a fragmentary cross sectional view taken along the line 13—13 of FIG. 11 and viewed in the direction of the arrows.

DETAILED DESCRIPTION OF THE INVENTION

Figure 1:
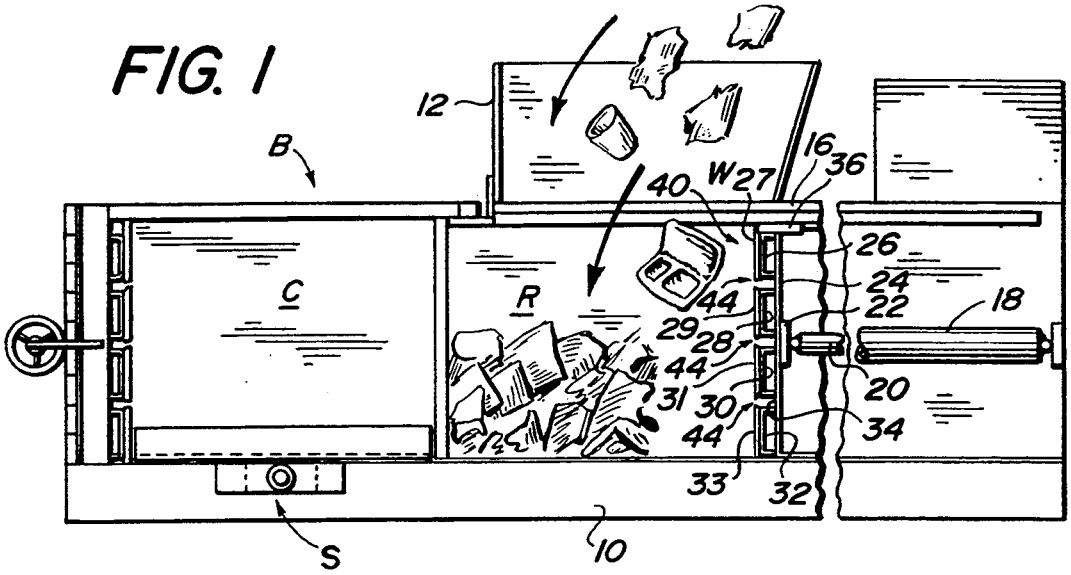
FIG. 1 is a fragmentary elevational view, partially in section, of a horizontal baler according to the invention with waste being placed into the receiving chamber.
Figure 2:
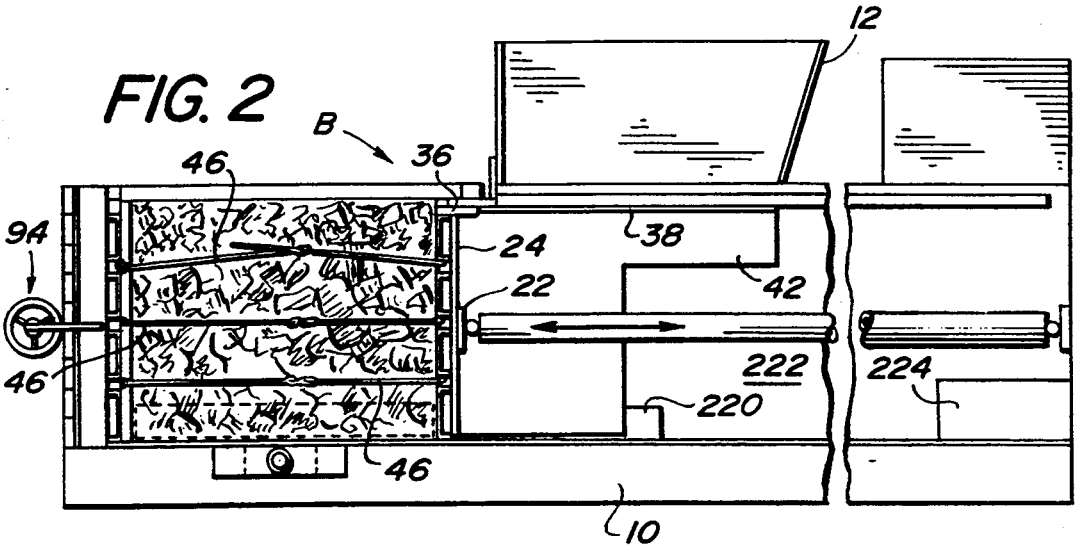
FIG. 2 is a fragmentary elevational view, partially in section, illustrating the baler of FIG. 1 after a bale has been formed and straps placed about it.
Figure 3:
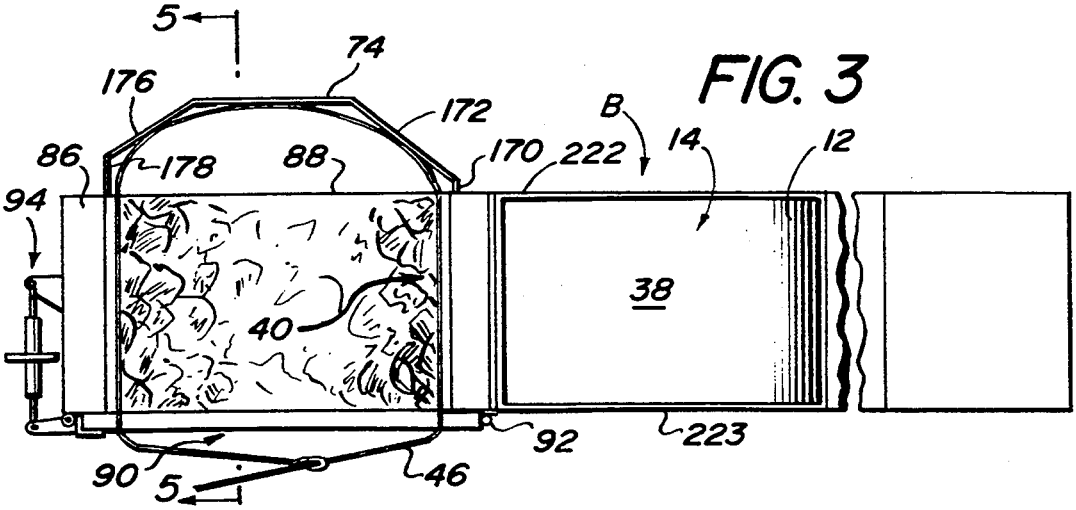
FIG. 3 is a fragmentary top plan view, with portions broken away, illustrating the baler of FIG. 2.

Horizontal baler B, as best shown in FIGS. 1–3, includes a ground engaging generally rectangular frame assembly 10. Receiving chute 12 communicates with receiving chamber R through opening 14 in top 16. Compaction chamber C is interconnected, adjacent, and aligned with receiving chamber R for reasons to be further explained.

Hydraulic cylinder 18 has a longitudinally extensible piston 20 connected to block 22. Block 22 is secured to vertically disposed plate 24 by welding or the like. Beams 26, 28, 30, and 32 are secured to front face 34 of plate 24 in spaced parallel relation, and plates 27, 29, 31 and 33 are secured, respectively, to the beams 26, 28, 30 and 32. Slide 36 is secured to plate 24 and beam 26 and extends rearwardly therefrom parallel to centrally disposed piston 20. Plate 38 is secured to slide 36 and extends rearwardly therefrom to provide a valve blocking chute 12 and closing opening 14 when the ram 40, formed by the beams 26, 28, 30 and 32 and plate 24, is in the forward or extended orientation shown in FIG. 2. The plate 38 is, preferably, secured laterally to supports 42, only one of which is shown in FIG. 2. The ram 40, when in the extended position of FIG. 2 delimits compaction chamber C.

Slots 44 are disposed in spaced parallel relation along ram 40 between the plates 27 and 29, 29 and 31, and 31 and 33. Slots 44 receive wires or bands 46 which extend about the compaction chamber C as will be further explained. Although I prefer that the bands 46 be wires or similar members which may be tied together, those skilled in the art will understand that there are various other means available for banding a bale.

Bale server S, as best shown in FIGS. 1 and 11–13, includes a center plate 48 disposed between parallel plates 50 and 52 within compaction chamber C. The plates 48, 50 and 52 provide a floor or bottom for the compaction chamber C. The plate 48 preferably has a width less than the width of the parallel plates 50 and 52, and the width should be less than the spacing of the forks on a handtruck, such as the truck 54 of FIG. 6. Because the plate 48 has a width less than the distance between the forks of the handtruck 54, then a bale, such as the bale 56 of FIG. 6, may be received by the truck 54 for transport to some further location.

Support tubes 58 and 60 are secured to the plate 48 along the lower surface 62 thereof. It can be seen in FIG. 12 that each of the tubes 58 and 60 is secured so that a portion of the adjacent plate 50 or 52 rests upon the corresponding tube 58 or 60 in order to provide lateral support for the plates 50 and 52. The tubes 58 and 60 extend substantially the length of the plate 48 in order to prevent bending of the plate 48 when in the bale serving or extended position illustrated in FIG. 6. Because the plates 48, 50 and 52 are laterally supported throughout their length, then there is minimal tendency for deflection or bending as the baler B is operated and a bale 56 formed.

Tubes 64 and 66 span the gap or openings 72 in the beams 68 and 70 of the ground engaging frame 10. Braces 74 extend between the tubes 64 and 66 in order to provide rigidity for the bale server S components. Plate 76 is welded to the tubes 64 and 66 and the braces 74 in order to provide a continuous support surface for the bale server S during retraction and extension of the plate 48.

Hydraulic cylinder 78 is connected to the ground engaging frame 10 at one end and has a piston 80 connected to plate 48 through block 82. The cylinder 78 is hydraulically operated, and extension or retraction of the piston 80 causes corresponding movement of the plate 48. I prefer that the cylinder 78 be a 2.5 in. bore cylinder, operating at 2,500 p.s.i. to generate about 12,300 pounds of force. Angle 84 is secured to the plate 48 and is movable therewith and extends the width of the compaction chamber C in order to prevent a bale from becoming stuck in compaction chamber C.

Compaction chamber C, as best shown in FIG. 3, is bounded at one end by ram 40, and at the opposite end by wall 86. A further wall 88 bounds one side of the compaction chamber C, while the opposite side is bounded by door 90. Door 90 pivots about hinge 92 in order to either close the compaction chamber C or to permit access thereto through the resulting opening. Door 90 is selectively securable by virtue of latch assembly 94 secured to wall 86.

Figure 8:
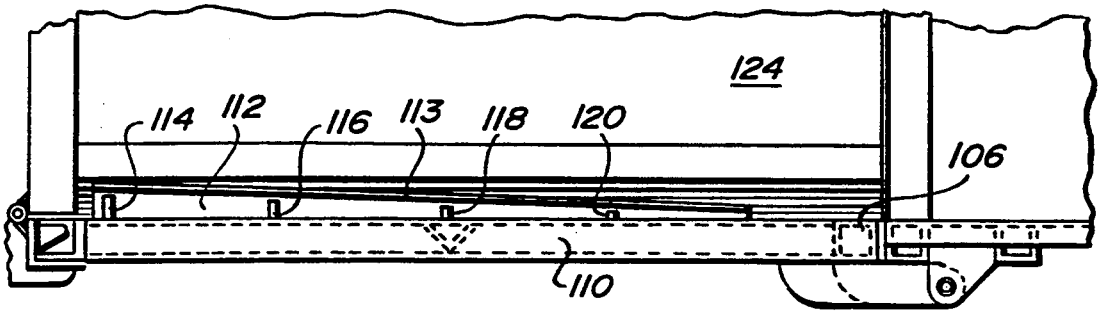
FIG. 8 is a fragmentary top plan view, with portions shown in phantom, of the ejection door of FIG. 7.
Figure 7:
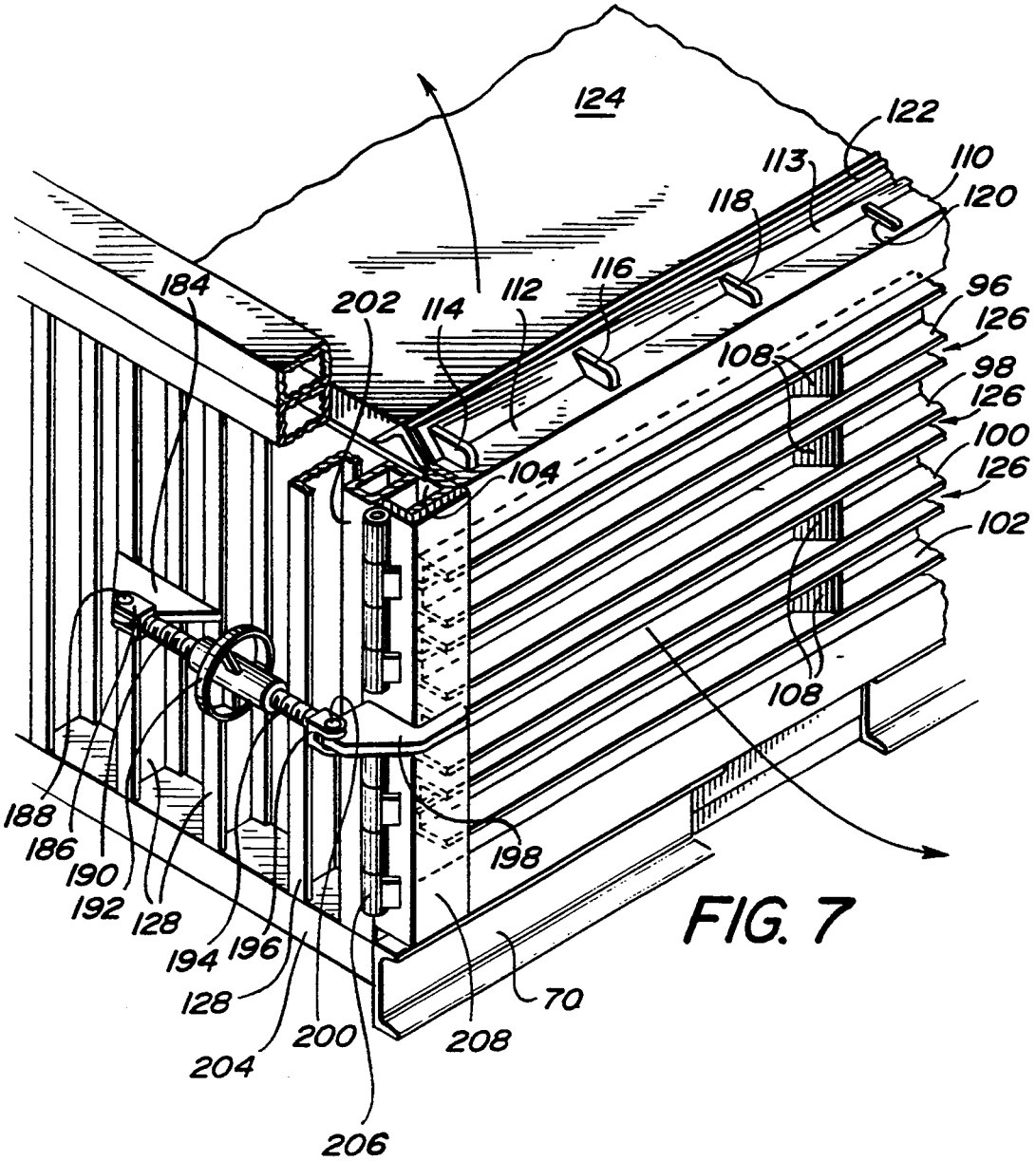
FIG. 7 is a fragmentary perspective view, partially in section, of the ejection door of the baler.

Door 90, as best shown in FIGS. 7 and 8, is defined by spaced parallel channels 96, 98, 100 and 102. Angle 104 and tube 106 extend in spaced parallel relation on opposite sides of door 90 and each of the channels 96, 98, 100, and 102 is secured thereto by welding or the like. Angles 108 are positioned within each of the channels 96, 98, 100 and 102 proximate the middle to provide support and to prevent bending of the channels by the compaction pressure exerted within the compaction chamber C. Beam 110 defines the upper limit of the door 90, and plate 112 extends angularly therefrom toward compaction chamber C. Plate 112, as best shown in FIGS. 7 and 8, has supports 114, 116, 118, and 120 in order to prevent the plate 112 from being bent as the door 90 is operated. It can be seen in FIGS. 7 and 8 that the plate 112 extends above the compaction chamber C the most adjacent the angle 104 and diminishes as the tube 106 is approached. Plate 112 overlies angle 122 secured to pivotal door 124 forming the top of compaction chamber C. The overlying relationship of the plate 112 to the angle 122 provides a lock so that the door 124 stays closed when the door 90 is in the latched position of FIG. 7.

Figure 5:
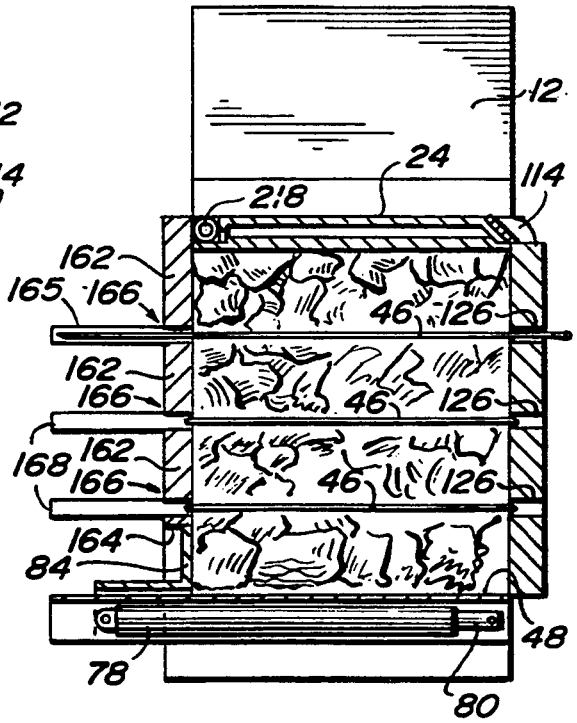
FIG. 5 is a cross sectional view taken along the line 5—5 of FIG. 3 and viewed in the direction of the arrows.

Slots 126 are formed in the door 90 between the channels 96 and 98, 98 and 100, and 100 and 102 in order to receive the bands 46, as best shown in FIG. 5. The slots 126 are aligned with the slots 44 in the ram 40 so that the wires or bands 46 may be easily passed therethrough when the bale 56 is being tied.

As best shown in FIGS. 9 and 10, wall 86 includes a plurality of spaced parallel beams 128. Channels 130, 132, 134,.and 136 are secured to the beams 128 and span the width of the compaction chamber C. Tubes 138 extend along the top of the beams 128 in order to provide rigidity. A further tube 140 is secured to the beams 128 and is disposed within the compaction chamber C and above the channel 136. Plate 142 has a lower tapered edge 152 and an upper flat edge 154 on which door 124 rests. The tapered edge 152 cooperates with adjacent tapered edge 156 of the plate 144 in order to provide a slot 158. Each of the plates 144, 146, 148 and 150 has tapered edges 152 and 156 in order to define for receiving a wire tie 46 slots 158. The tapered edges provide a relatively small opening for waste material, and thereby prevent the chambers 160 from becoming blocked. It can be seen in FIG. 10 that each of the chambers 160 has a vertical dimension much in excess of the vertical dimension of the corresponding slot 158, thereby facilitating positioning of the wire bands 46 about chamber C. The wire bands 46 are smaller than the slots 158, so that they may be pulled therethrough when the bale 56 is being tied or the pressure released and the bale permitted to expand. Each of the slots 158 is aligned with one of the slots 126 in the door 90.

Wall 88, as best shown in FIG. 5, is formed by braced, spaced, parallel plates 162. A lower plate 164 is disposed above angle 84 which provides the lower limit for wall 88. Slots 166 are formed between the plates 162 and 164 in order to receive the wire ties 46. Slots 166 need not be tapered, because I wish the opening to be relatively large in order to permit relative ease in the insertion of wire ties 46.

I have found that guides 168 should be provided in alignment with the slots 166 in order to permit the wire ties 46 to more easily turn about the wall 88 in order to be received within the slots 158 of the wall 86 or slots 44 of ram 40. The guides 168 have an opening of about the vertical dimension of the slots 166. Guides 168 are defined by members 170, 172, 174, 176, and 178, as best shown in FIG. 3, to which upper and lower plates 180 and 182, respectively, are secured. Although the guides 168 extend outwardly from the wall 88 by some distance, they do not extend so far as to take up an inordinate amount of space and they have a generally rounded orientation in order to cause the ties 46 to bend and thereby extend through the slots 158 and 44. The baler B still requires relatively little floor space, and the configuration of the guides 168 is such as to minimize tripping and striking hazards.

Latch assembly 94, as best shown in FIGS. 7 and 9, includes a bracket 184 secured to an adjacent two of the beams 128. Clevis 186 is hingedly secured to bracket 184 by pin 188. Threaded shaft 190 extends from clevis 186 and is threadedly engaged with turnbuckle 192. Threaded shaft 194 extends from the opposite side of turnbuckle 192 and has clevis 196 hingedly connected to fork 198 by pin 200. The threads on the shafts 190 and 194 are oppositely oriented, so that rotation of the turnbuckle 192 causes the shafts 190 and 194 to be either drawn into the turnbuckle 192 or be moved outwardly relative thereto in order to cause corresponding movement of the fork 198.

Tube 202 is welded to beam 204 interconnecting beam 70 with beam 68, as best shown in FIG. 7. Hinge assembly 206 has a first portion secured to tube 202 and a second portion secured to angle 208. Angle 104 as best shown in FIG. 9, has a surface 210 against which tine 212 is received. Tine 214 of fork 198, on the other hand, is disposed outwardly of and secured to angle 208. Tine 212 is disposed at an angle to tine 214 in order to permit the fork 198 to be pivoted about pin 200 before the surface 216 of tine 212 engages the interior of the tube 104. Surface 216 acts as a camming surface to help force door 90 open in the event it should become stuck in the closed position.

Figure 4:
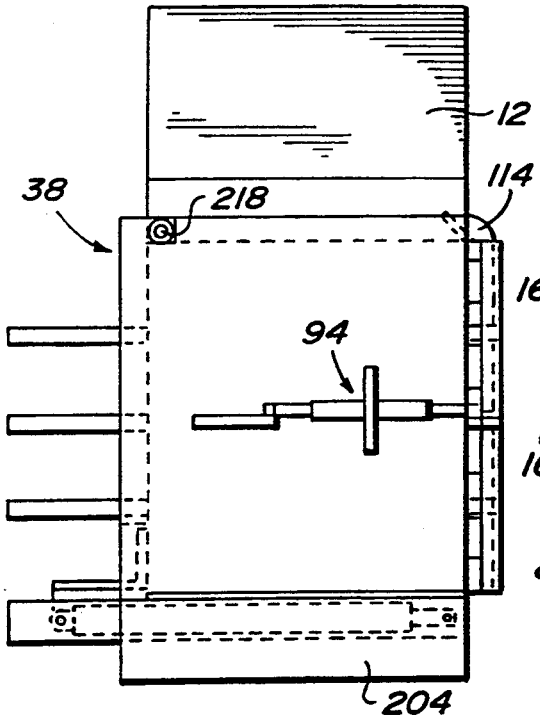
FIG. 4 is a front elevational view of the baler of FIG. 1.
Figure 6:
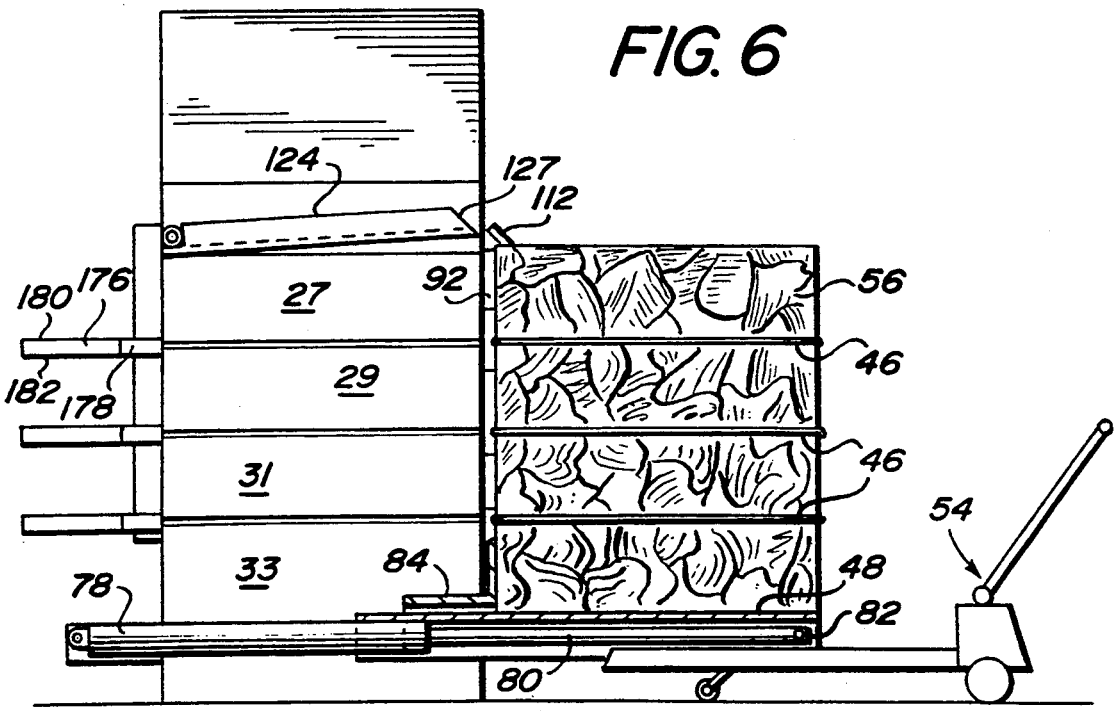
FIG. 6 is an elevational view, partially in section, illustrating the bale of FIG. 5 being ejected from the compaction chamber.

Door 124 pivots about hinge 218 connected to wall 88, as best shown in FIGS. 4–6. The door 124 moves about an axis defined by the hinge 218 which is spaced from and disposed transverse to the axis about which the door 90 moves by virtue of the hinge 92. Because of the overlying relation of the plate 112 to the angle 122, then the door 124 will remain in the closed position, as illustrated in FIGS. 4 and 5, when the door 90 is likewise in the closed position.

Operation of the turnbuckle 192 causes the angle 208 to pivot about the hinge assembly 206 in order to permit the door 90 to be opened. Opening door 90 likewise allows the door 124 to open. Rotation of the turnbuckle 192 is performed manually, so that the door 90 opens and closes relatively slowly. Because of the relative slowness with which the door 90 opens, then the compaction pressure exerted on the bale 56 is slowly relieved. A slow release of the compaction pressure substantially minimizes any tendency for objects within the compaction chamber C to be violently expelled. I furthermore relieve the compaction pressure by moving the ram 40 relative to the compaction chamber C by a distance sufficient to allow expansion of the bale 56 and by pivoting the door 124 upwardly as shown in FIG. 6. Release of the pressure on the bale 56 within the compaction chamber C causes a slight expansion in the bale 56, thereby minimizing the need to have the ties or bands 46 pooled tight against the bale 56 initially. The bands or ties 46 may therefore be placed by hand, because the expanding bale 56 will pull them snug.

Operation of the baler B is relatively simple, and minimizes the complexities of the prior two-ram and closed-end balers. The baler B also occupies minimal floor space, thereby avoiding the relatively large size of the conventional two-ram balers.

The ram 40 may be maintained in the extended position, as shown in FIG. 2, so that material W deposited within chute 12 is prevented from entering the interior by the plate 38. Plate 38 therefore serves as a valve. Once sufficient material is within the chute 12, then piston 20 is retracted, thereby causing the ram 40 to also retract and permit the material to fall into receiving chamber R. After the material has been received within the chamber R, then the ram 40 is moved forwardly by extension of the piston 20. The cylinder 18 preferably has a 7 in. bore and generates 96,200 pounds of force at 2,500 p.s.i. The ram 40 moves forwardly so that all material is transferred into the compaction chamber C, and any hanging from the chute 12 is broken by the force of cylinder 18. Ram 40 may, as noted, be maintained in the extended or forward position until it is desired to once again cycle the ram 40 for transferring other material from the chute 12 into the receiving chamber R and ultimately into the compaction chamber C. This cycling operation is continued until the material within the compaction chamber C has obtained a suitable degree of compaction. Adequate compaction is determined through the use of a limit switch, timer, and pressure sensor. I provide a switch 220 attached to side wall 222 or wall 223 in order to determine when the piston 20 has reached maximum extension. The control system 224 for the hydraulic drives has a timer and pressure sensor, so that a compacted bale may be detected. Should five (5) seconds and a pressure of 2,300 p.s.i. be required to trip limit switch 220, then I know that adequate compaction has occurred and that the bale is ready to be tied and ejected.

Once the material within the compaction chamber C has attained the desired degree of compaction, then the ties or straps 46 are manually inserted through the slots 126, and then through the slots 44, and 166 and into the guides 168, where they are turned so as to exit on the opposite side in order to move through the slots 160. The ties then extend through the slots 126 in the door 90, and are manually tied as illustrated in FIG. 3. After all straps 46 have been thus inserted and tied, then the ram 40 is partially retracted, and the turnbuckle 192 is operated in order to permit the door 90 to be opened. Because of the tapered edge 113 on the plate 112, then the door 124 will slowly open as the door 90 pivots about the hinge 92 as a result of the camming surface 216 engaging angle 104. Slow opening of the doors 90 and 124 in combination with retraction of the ram 40 permits the tied bale 56 to expand slightly within the compaction chamber C in order to cause the ties 46 to become snug. Once the ties 46 have become snug, then the door 90 is pivoted by the full amount, as shown in FIG. 6, thereby exposing the,opening to the compaction chamber C.

Once the door 90 has been pivoted to the open position of FIG. 6, then piston 80 is extended. Extension of the piston 80 causes the plate 48 to be moved through opening 72. The tied bale 56 moves with the plate 48 because of the angle 84. The tied bale 56 thus moves through the opening provided by the door 90, and may be removed from the bale server S by the truck 54 or similar transport means.

Once the tied bale 56 has been removed, then the door 124 lowers and rests on the edge 154 of plate 142 and the door 90 is pivoted into the closed orientation of FIGS. 4 and 5. When the door 90 has been closed, then the turnbuckle 192 is once again manually rotated, so that the fork 198 causes the angle 208 to engage the angle 104 and thereby lock the door 90 in the closed position.

Because of the bale server S, then a partially compacted bale may be removed from compaction chamber C. This feature permits different types of materials to be baled without intermingling occurring. Typical two-ram and closed end balers use the formation of one bale as the ejection force for an already formed bale, thus permitting material intermingling to occur.

While this invention has been described as having a preferred design, it is understood that it is capable of further modifications, uses and/or adaptations of the invention, following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. The method of baling material, comprising the steps of:

a) placing material to be baled into a receiving chamber;

b) reciprocating a ram between first and second ends of the receiving chamber and thereby transferring the material into an adjacent compaction chamber limited by the ram when at the first end;

c) continuing to place material into the receiving chamber and to transfer the material into the compaction chamber and thereby causing the material in the compaction chamber to be compacted into a bale;

d) placing straps about the bale while in the compaction chamber after a desired degree of compaction has been achieved;

e) relieving the compaction pressure on the bale by moving the ram from the first end toward the second end and thereby allowing the bale to expand against the straps; and f) moving a first door defining a portion of the compaction chamber, the first door being selectively movable between a first orientation closing the compaction chamber and a second orientation providing a first opening communicating with the compaction chamber;

g) moving a second door defining the top of the compaction chamber, the second door being selectively movable between a first orientation closing the compaction chamber and a second orientation providing a second opening communicating with the compaction chamber; and h) moving a support which defines a portion of the compaction chamber bottom through the first opening for discharging said compacted and strapped bale of material therethrough.

2. The method of claim 1, including the steps of:

a) actuating a first hydraulic drive means mounted to the ram for causing reciprocation thereof; and b) actuating a second hydraulic drive means disposed below the support and operably connected thereto for causing movement thereof.

3. The method of claim 2, including the steps of:

a) pivoting each of the doors between the orientations; and b) pivoting the first door on an axis transverse to the axis on which the second door pivots.

4. The method of claim 3, including the steps of:

a) overlying a portion of the first door with a portion of the second door such that the first door is engageable with the second door when the doors are in the first orientations for securing the second door in the first orientation; and b) securing the first door in the first orientation by securing means which are operably associated with the doors.

5. The method of claim 4, including the steps of:

a) providing the first door with oppositely disposed first and second ends;

b) pivoting the first door about an axis associated with the first end;

c) providing securing means which are operably associated with the second end; and d) pivoting a member about an axis disposed parallel to the axis about which the first door pivots between a first position in securing engagement with the first door and a second position remote therefrom.

6. The method of claim 5, including the step of:

a) reciprocating a drive means along an axis transverse to the axis on which the member pivots.

7. The method of claim 6, including the steps of:

a) providing first and second threaded shafts, one of the shafts operably connected to the member and the other of the shafts secured to the compaction chamber;

b) rotating a turn buckle which is threadedly engaged with each of the shafts so that rotation of the turn buckle causes movement of the shaft and thereby pivoting of the member;

c) providing a plate and first and second spaced tubes secured to the plate along the lower surface thereof; and d) providing the second hydraulic means which is disposed between the tubes and has a first portion secured to the receiving chamber and a second extensible portion secured to the support.

8. The method of claim 7, including the steps of:

a) providing a brace secured to the plate along an upper surface thereof and defining a portion of an associated side of the compaction chamber;

b) providing a plurality of spaced parallel line slots in the ram and the sides of the compaction chamber for permitting insertion therethrough of a banding strap; and c) providing adjacently disposed members defining each of said slots, at least two of the members having an edge tapering from the compaction chamber in order to provide a strap receiving chamber.

9. A method for compacting material and ejecting a strapped compacted bale therefrom, comprising the steps of:

a) placing material to be baled into a receiving chamber;

b) reciprocating a ram between first and second ends of the receiving chamber thereby transferring the material into an adjacent compaction chamber limited by the ram when at the first end, the compaction chamber and receiving chamber mounted upon a generally rectangular ground engaging frame assembly, the ram being movable by a first cylinder and piston assembly which is longitudinally disposed within the frame assembly and operably associated with the ram for causing reciprocation thereof, the compaction chamber having a top, a bottom and sides;

c) continuing to place material into the receiving chamber and to transfer the material into the compaction chamber and thereby causing the material in the compaction chamber to be compacted into a bale;

d) placing straps about the bale while in the compaction chamber after a desired degree of compaction has been achieved;

e) relieving the compaction pressure on the bale by moving the ram from the first end toward the second end thereby aligning the bale to expand against the strap;

f) moving a first door which defines one of the sides of the compaction chamber from a secured position to an unsecured position so as to provide an opening for the compaction chamber;

g) reciprocating a support which is mounted transverse to the first cylinder and piston assembly and is aligned with the door for discharging said compacted and strapped bale of material through the opening, the support defining a portion of the bottom of the compaction chamber; and h) reciprocating a second cylinder and piston assembly which is operably associated with the support and is disposed transverse to the first cylinder and piston assembly.

10. The method of claim 9, including the steps of:

a) pivoting the door about an axis extending transverse to the second cylinder and piston assembly; and b) securing the door in a position closing the openings by means which are mounted to the frame assembly on a side of the door opposite the axis.

11. The method of claim 10, including the steps of:

a) providing a door which has oppositely disposed first and second sides, the first side thereof being hingedly connected to the frame assembly;

b) pivoting the door about the axis, the second side of the door being operably associated with the securing means; and c) providing securing means which includes a portion extending substantially the length of the door second side.

12. The method of claim 11, including the steps of:

a) providing a second axis extending parallel to the first axis, the portion being pivotal about the second axis; and b) providing the securing means with drive means operably associated with the portion for pivoting the portion about the second axis between a first position wherein the door may be pivoted to expose the opening and a second position securing the door.

13. The method of claim 12, including the steps of:

a) extending the drive means in a direction generally transverse to the second axis, the drive means being adapted for relatively slowly pivoting of the portion about the second axis:; and b) permitting the door to be relatively slowly pivoted about the first axis so that pressure in the compacted material may be released.

14. The method of claim 13, including the steps of:

a) providing first and second threaded shafts, one of the shafts being secured to the frame assembly and the other of the shafts secured to the portion; and b) rotating a turnbuckle which is operably engaged with each of the shafts so rotation of the turnbuckle causes associated movement of the shafts relative thereto for thereby causing associated pivoting of the portion.

15. The method of claim 14, including the steps of:

a) providing said compacting chamber which is generally U-shaped in plan and is defined by first, second, and third sides, and each side extends generally transverse to the adjacent side so that the first and second sides extend in parallel;

b) providing said first door which is operably associated with the first side; and c) providing drive means which are operably associated with the second side.

16. The method of claim 15, including the steps of:

a) moving a second door between a closed and open position, the second door defining the top of the compaction chamber;

b) locking the first and second doors of the compaction chamber in the compaction chamber defining orientations with a lock means; and c) providing each of the doors with a pivotal axis of rotation, the axes being generally perpendicular to each other.

17. The method of claim 16, including the steps of:

a) providing a first door axis which is associated with one side of the compaction chamber and the second door axis which is associated with an opposite side of the compaction chamber; and b) providing a first door lock means which includes a first angle member and the second door lock means includes a second angle member, one of the members overlying the other for maintaining the doors in the compaction chamber defining orientations.

18. The method of claim 17, including the steps of:

a) providing a first member which overlies the second member; and b) providing strapping means which includes a plurality of aligned slots in each of the compaction chamber sides and the ram, each of the slots for receiving a banding strap.

* * * * *